US005941261A

United States Patent [19]

Kouvaras et al.

[11] Patent Number: 5,941,261

[45] Date of Patent: Aug. 24, 1999

[54] CONICAL TENSION MEMBRANE STRUCTURE

[75] Inventors: Anastasios Kouvaras; Peter Mark Kamons; Peter John McConachie, all of Brisbane, Australia

[73] Assignee: Shade Structures Pacific Pty Ltd et cetera, South Brisbane, Australia

[21] Appl. No.: 08/391,492

[22] Filed: Oct. 31, 1994

[51] Int. Cl.[6] ..... A45B 25/02

[52] U.S. Cl. ..... 135/27; 135/23

[58] Field of Search ..... 135/20.3, 19.5, 135/23, 27, 28

[56] References Cited

U.S. PATENT DOCUMENTS

| | | | |
|---|---|---|---|
| 559,577 | 5/1896 | Hadfield | 135/27 |
| 1,157,974 | 10/1915 | Behling | 135/27 X |
| 1,444,017 | 2/1923 | Waschek | 135/27 X |
| 2,143,978 | 1/1939 | Eeles | 135/27 X |
| 2,502,984 | 4/1950 | Parmenter | 135/16 X |
| 2,522,645 | 9/1950 | Senna | 135/27 |
| 2,534,710 | 12/1950 | Golian et al. | 135/22 X |
| 2,561,435 | 7/1951 | Woodward | 135/27 X |
| 3,930,514 | 1/1976 | Wu | 135/27 |
| 4,407,317 | 10/1983 | Crandall | 135/27 |

FOREIGN PATENT DOCUMENTS 572753 9/1985 Australia .

*Primary Examiner*—Beth Aubrey
*Attorney, Agent, or Firm*—William H. Eilberg

[57] ABSTRACT

A conical tension membrane structure capable of resisting high winds in which the fabric is tensioned both radially and tangentially by radial support arms operable to provide tension peripherally by radial support arms, operable to provide tension peripherally of the fabric and being foldable to a closed position, with cover supported by radial cables, and arms held down by hold-down cables.

9 Claims, 5 Drawing Sheets

CONICAL TENSION MEMBRANE STRUCTURE

BACKGROUND OF THE INVENTION

1. Field of the Invention

This invention relates to a conical tension membrane.

2. Prior Art

A structure which may be used for a similar purpose such as a garden umbrella, which affords a substantial area of shade and weather protection, has a flexible cover, centrally fixed near to the top of the central staff, and lying against an assembly of arms pivotally connected to the staff. The perimeter of the cover being secured at intervals to the outer ends of the arms. The arms may be extended by sliding up the shaft a sleeve connected to intermediate positions on all of the arms by pivoted struts, with a catch or pin to hold this sleeve when fully raised. When the garden umbrella is thus raised, its fabric cover is tensioned tangentially as the arms are raised but there is little radial tension applied to the cover. As a consequence of this, the cover is likely to flutter in high winds. A further disadvantage is the difficulty encountered in raising it, as the arms, bearing the weight of the cover, must be extended by forcing the sleeve upwards towards the struts, initially lying close to the shaft, to swing outwards, A very considerable effort is required to do this, both during the initial movement of the sleeve and during its final movement which is resisted by the tangential tensioning of the cover.

The prior art also includes the form of "umbrella" as described by Australian Patent Number 572753. In this previous device the conical form fabric is tensioned and restrained by arms pushed downward and outwards to the fabric. The fabric is usually unable to prevent significant deflection of the arms and overstressing of the top of the fabric under high downward wind pressures even when it incorporates pliable reinforcing strips.

This is not only because of the limited stiffness of such strips, but more importantly because they are attached to the fabric over its whole radial extent. Significant downward deflection of the outer end of the arms is necessary to straighten these radial seams from their pre-curved geometry, and before extension of these strips can occur. It is not until these strips can extend that significant restraining forces can be generated. This effect is particularly important in structures with few arms and high fabric curvatures.

Furthermore, this type of structure is not suited to resisting high upward wind pressures or particularly a combination of downward pressure on the windward side and upward pressure on the leeward side.

The device in APN 572753 has two design problems:

Firstly, the structure as per Australian Patent Number 572753 proved in use to not be stable in high winds due to lifting of the tips of the arms under strong negative pressure. This is resolved by the use of hold down cables.

Secondly, APN 572753 use webbing reinforcement integral in the seams. This proved, in use, not to be sufficiently stiff to adequately support the arms, which is what the design requires.

Thus, the design of the structure in APN 572753 had adequacies in the role that was required of it, namely, to be a stable structure, capable of resisting high winds.

The invention described herein meets this basic requirement.

BRIEF SUMMARY OF THE INVENTION

The present invention has been devised with the general object of providing a tension membrane structure suitable for covering large areas, which may be quickly and easily raised to its operative position and which will have a high resistance to flutter in high winds.

With the foregoing and other objects in view, the invention resides broadly in a conical membrane structure, including a substantially vertical shaft; a pliable cover; cover attachment means for securing the cover substantially centrally to the upper part of the shaft; at lease three support arms; arm attachment means for connecting the support arms pivotally at one end to and extending from the shaft below the cover; the outer ends of the support arms being secured at spaced positions to the peripheral part of the cover, characterised by actuating means for bringing the arm attachment means, and the cover attachment means towards each other to fold the support arms and cover, or away from each other to extend the support arms towards perpendicularly to the shaft, opening the cover and radial cables under the fabric, and tensioning it both radially and tangentially. The arms are prevented from reaching the horizontal by means of hold-down cables attached to the tips of the arms and to the upright shaft at a lower height than the arm attachment. The arms are prevented from sagging by the radial cables. Preferably, the arm attachment means is a sleeve to which the support arms are pivoted, and the hold-down cables are also attached at a lower level, and slidable on the shaft.

One possible variant occurs for more steeply rising conical shapes. In this case the arm angle may be sufficiently steep as not to require the use of uplift cables. Furthermore the top connection point of radial support point may occur some distance down the central pole from the top support structure. This connection point may also be arranged to attach to an additional collar, capable of moving only a limited distance down the central pole to a fixed stop but also capable of moving upward on collapse of the structure.

Other preferred features of the invention will become apparent from the following description.

BRIEF DESCRIPTION OF THE DRAWINGS

In order that a preferred embodiment of the invention may be readily understood and carried into practical effect, reference in now made to the accompanying drawings wherein.

DETAILED DESCRIPTION OF THE PREFERRED EMBODIMENT

Figure 1:
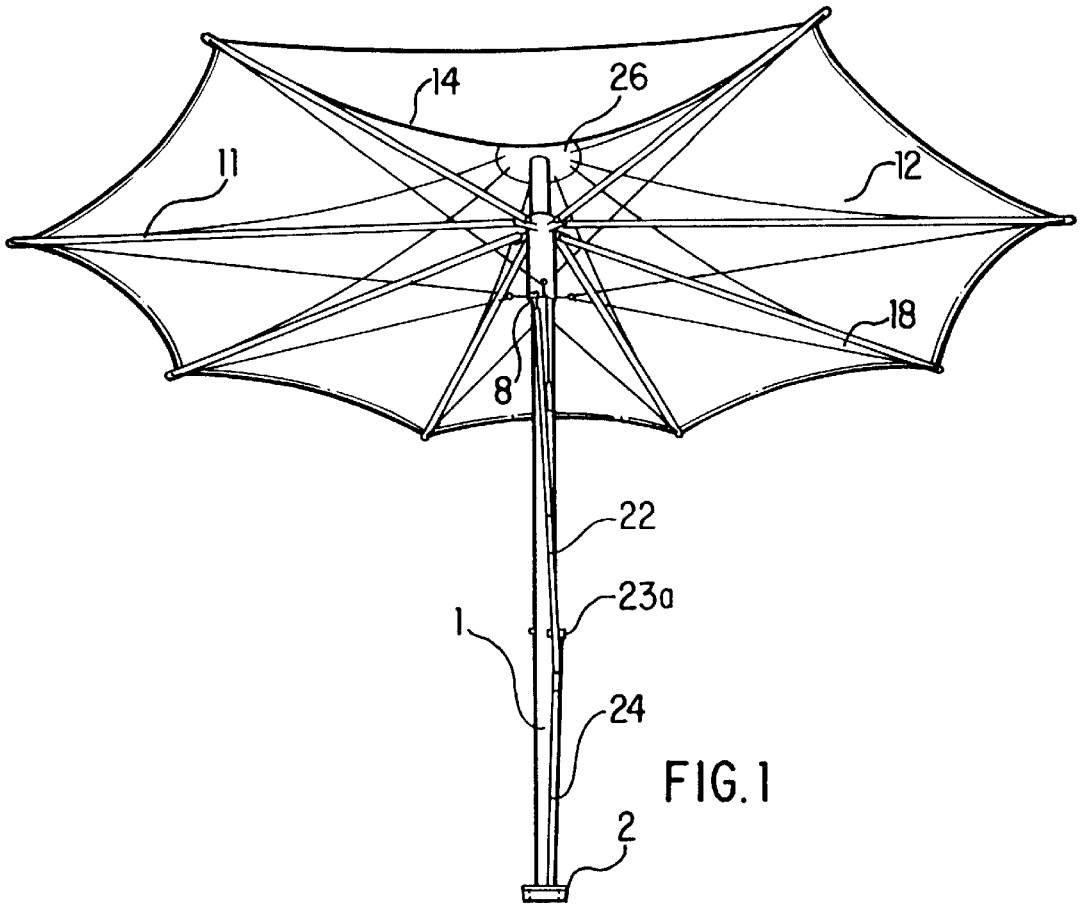
FIG. 1 is a perspective view of the conical tension membrane structure according to the invention, in its fully raised position.
Figure 4:
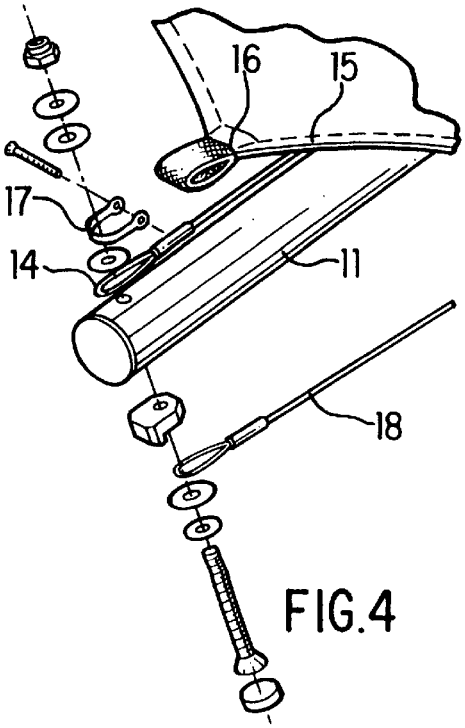
FIG. 4 is a perspective view showing the attachment of the membrane cover and the hold-down cables to one of the support arms.

The conical tension membrane structure illustrated in FIGS. 1 to 6 includes a shaft (1) which may be of metal tube, its lower end welded or otherwise secured to a base plate (2), which may be bolted to a concrete or other foundation; or alternatively the lower end of the shaft may be closely engaged in a socket or embedded in concrete.

Mounted coaxially on the top of the shaft (1) is a top plate (3) with a ring (4) and a diametral cross piece (13) bolted or otherwise fixed to the shaft. A threaded pin (6) secures a conical cap (7) to the top plate (3). Cable terminations fixing points (26) are attached to the underside of top plate (3).

A sleeve (8) is slidable on the shaft and has radiating lugs (9) extending therefrom into which is fixed a pivotal pin (10) on each side of the lugs. Each of the pins pivotally receives an inner end of a support arm (11) which may be made of metal. The pivot pins are angled with respect to the lugs such that the support arms are angled and when raised towards the horizontal will be tangential to a plan section of the shaft (1). It is important that these arms are paired so that there are an equal number tangential clockwise to the shaft, as well as anti-clockwise to the shaft. If the arms are truly radial to the shaft, the sleeve may tend to rotate around the shaft.

A flexible cover (12) which may be of close-woven fabric, or open weave shade cloth, or any other suitable sheet material, is formed with a central opening (5) where it is connected to the top plate (3) and ring (4), and at its periphery it is secured to the ends of the support arms (11). The cover is made up of a number of substantially triangular panels, the junctions of the panels being supported by cables as indicated at (14). The ends of the cables are mechanically fixed to the top plate. The outer ends of the cable protrude beyond the periphery of the cover.

The outer end of the cable is bolted to the outer ends of the support arms (11). The perimeter reinforcement (15) is looped (16) and engaged by shackles (17) bolted to the outer ends of the support arms (11).

The central opening of the cover (12) is closed by a conical cap (7) of sheet metal, spun metal, moulded plastic or other suitable material, centrally apertured to accept the upper end of the threaded pin (6).

Figure 5:
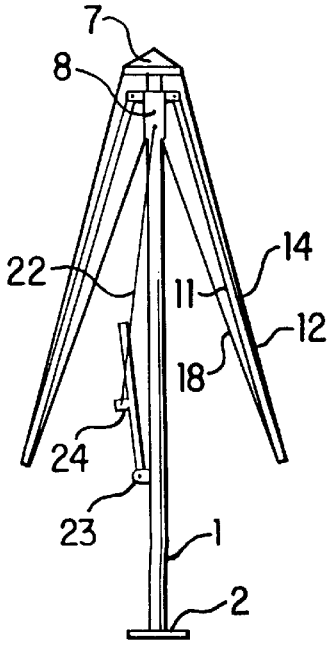
FIG. 5 is a diagrammatic drawing showing the arrangement of cover and support arms in folded position.

When the conical tension membrane structure is in its folded position, as shown diagrammatically in FIG. 5, the support arms (11) and cables (14) and (18) and tensioners (19) hang down from the sleeve (8) which is near to the top of the shaft (1) and the flexible cover (12) folds about the assembly of support arms. The conical tension membrane structure may be quickly and easily brought to the fully extended or raised position shown in FIG. 1 by drawing the sleeve (8) slidable downwards on the shaft (1) so that the support arms (11) and cables (14) and (18) are caused to swing outwards, opening the cover (12) and tensioning it both radially and tangentially, the cover (12) being such that the support arms (11) approach but do not reach perpendicularly to the shaft (1). The sleeve (8) is then locked in its fully lowered position by any suitable means such as a bolt or pin (not shown) passed through a tube (20) which may be attached to the sleeve (8) by an adjustment device (21) such as a threaded rod; or by spring-loaded plunger (not shown) in the sleeve, engaging the hole in the shaft; or by a spring catch (not shown) in the shaft similar to the catch on an umbrella, but inverted, for engaging and releasably holding the sleeve (8) when fully lowered. To collapse or fold the structure, the sleeve (8) is simply released and moved slidably upwards on the shaft (1).

Figure 2:
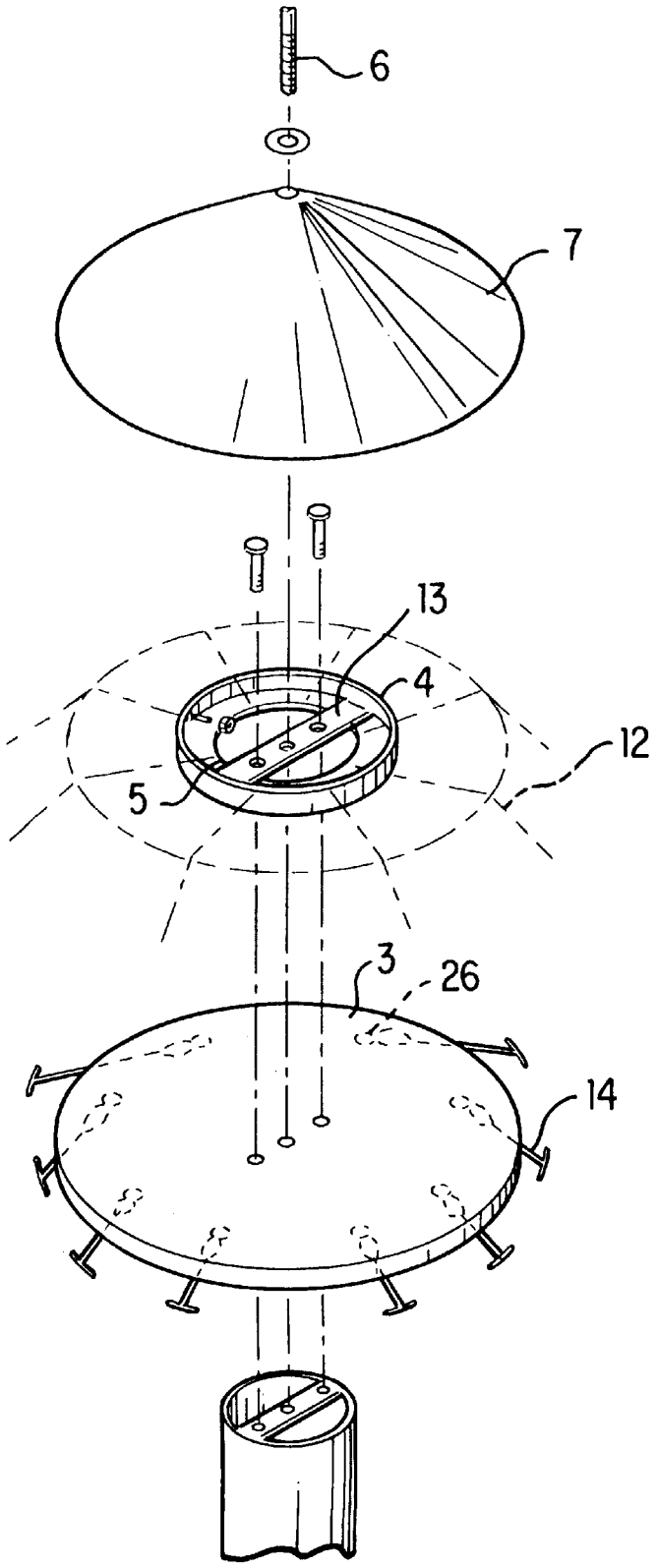
FIG. 2 is an exploded view of the upper part of the conical tension membrane structure.
Figure 3:
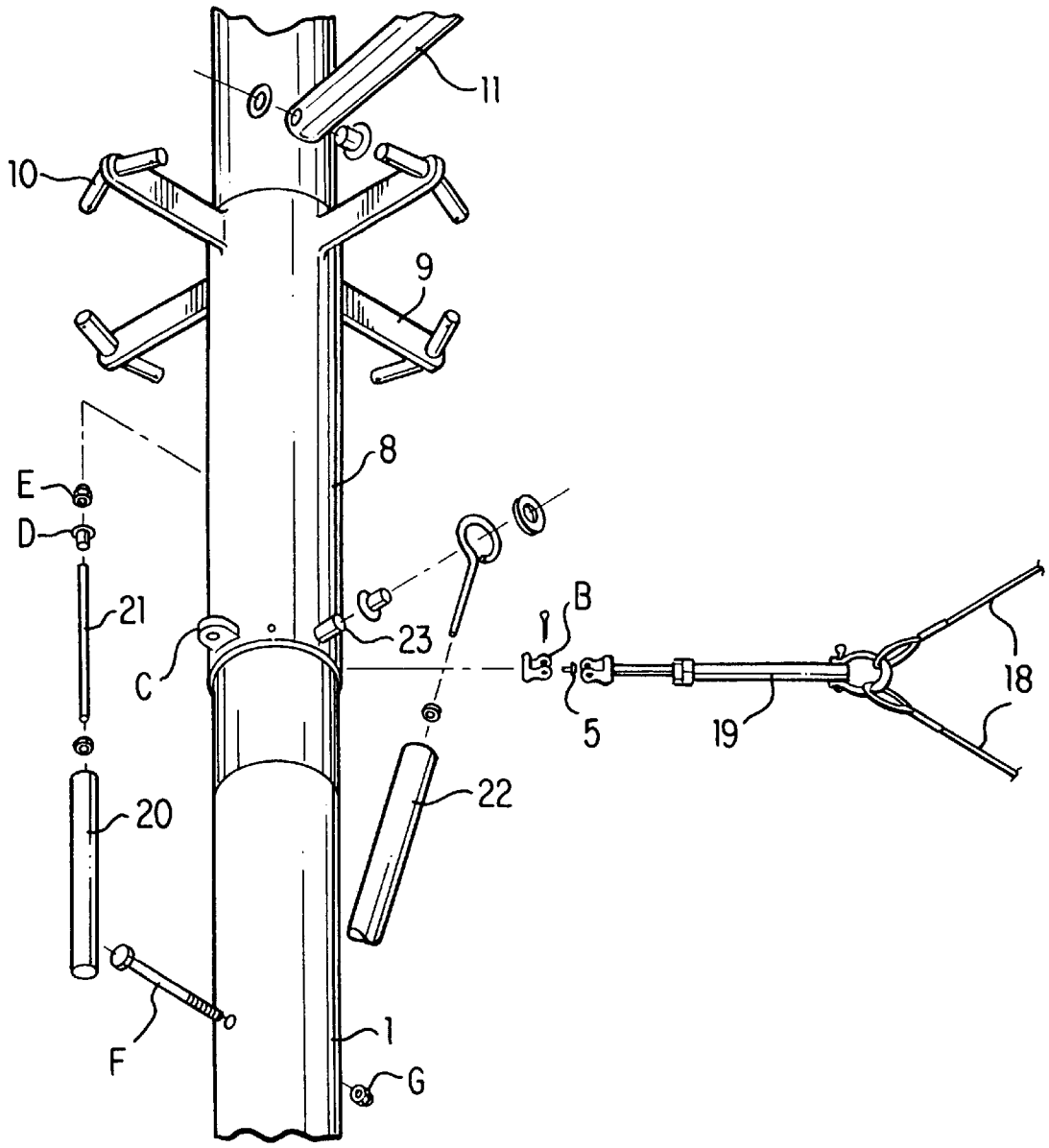
FIG. 3 is a perspective view showing the pivotal attachment of its support arms, and also the attachment of the hold-down cables with the required tensioner, and also the lock down device.
Figure 6:
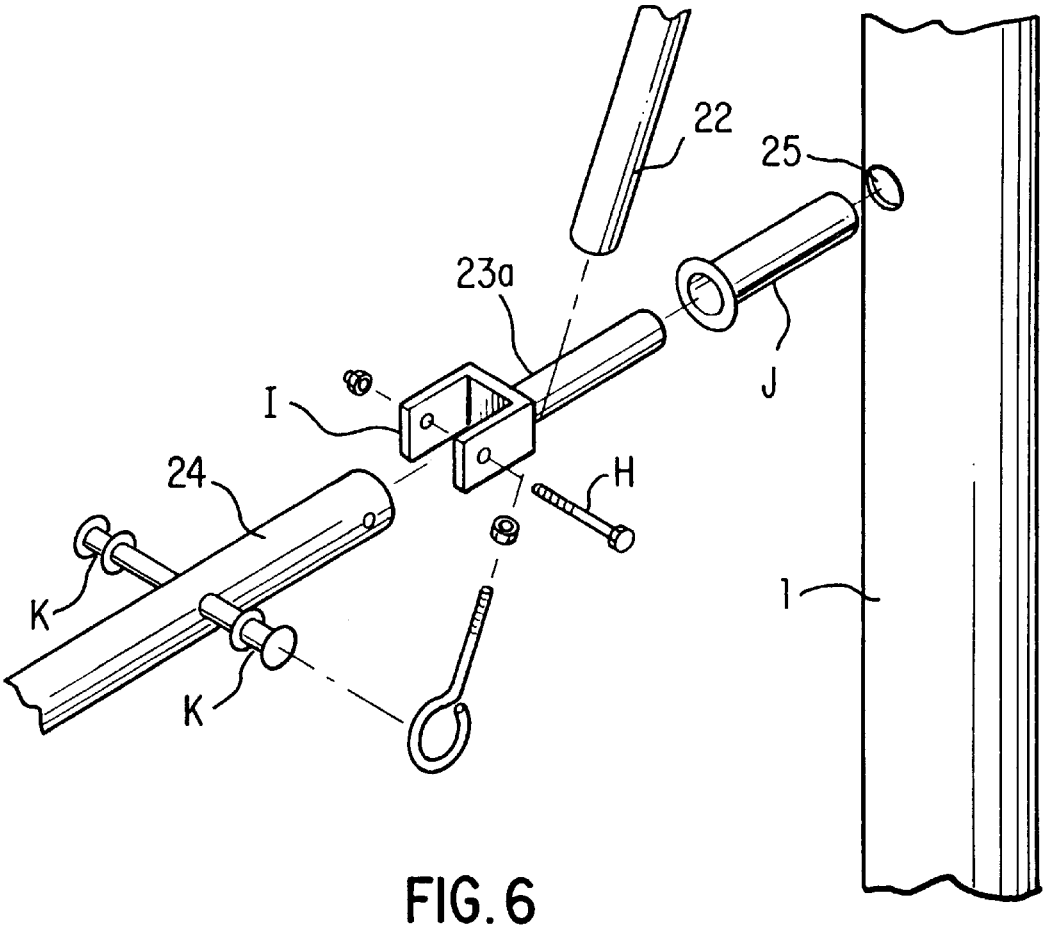
FIG. 6 is a perspective view of the erection mechanism.
Figure 7:
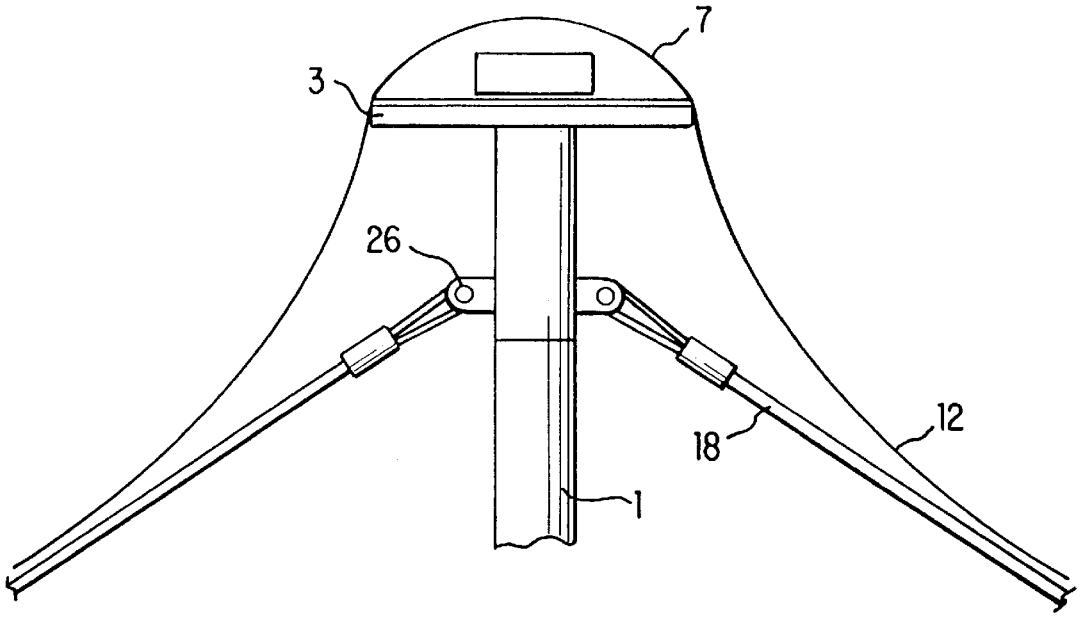
FIG. 7 is an alternative arrangement of the top of the structure.

The inner end of each cable (18) is attached to the sleeve (8) via an adjustable length tensioner (19), while the other end of the tensioner is pivotally connected to a bracket (B) via a screw (5). The cables (18) limit the upward movement of the arms (11) and stabilize the arms against uplift forces on the flexible cover (12), as shown in FIGS. 1 and 5. One cable (18) is provided for each arm (11), as shown in FIGS. 1 and 2.

The adjustment device (21) can be a threaded bolt (shown in FIG. 3) which has its upper end engaged in a bracket (C) on the sleeve (8), and which is secured by a washer (D) and a nut (E). The lower end of the bolt is engaged in the tube (20). A bolt (F), secured by a nut (G), releasably secures the tube to the shaft (1).

To facilitate the lowering and raising of the sleeve (8), an actuating link (22) may depend from a pivot pin (23) on the sleeve (8), and be connected at their lower ends to an actuating lever (24) fulcrumed at (25) on the shaft, the parts being so made and arranged that when the sleeve (8) has been fully depressed, the actuating links (22) have been moved beyond 'dead centre' positions to restrain the sleeve from returning towards its raised position.

The handle (24) is pivotally mounted via pivot pin (H) in a yoke (I) on bracket (23*a*) which is received in a sleeve (J) engaged in hole (25) in the shaft (1). Bracket (23*a*) is independent of sleeve (J) and both are fitted in the sleeve (J) and shaft (1) respectively. The pin (H) provides the fulcrum for the handle (24). Two links (22) are provided, as indicated by stub axles (K) in FIG. 6, but the figure shows only one link for clarity.

It will be appreciated that when the umbrella has been fully opened, its cover (12) is subjected to considerable tension tangentially as well as radially, and the outer ends of the arms are restrained by the radial cables (14) and hold-down cables (18). Because of this the structure is very stable and will resist high wind loadings without flutter of the fabric cover or significant vertical movement of the arms. A garden umbrella does not generate large radial forces. In this structure, the cover supports the arms and only touches the arms at the outer periphery, while in a garden umbrella the arms support the cover and the cover is in physical contact with the arms for the whole length of the arm. The device as described by APN 572753, is simply unstable in high winds.

The structure may be brought to its operative or fully opened position quickly and easily, with the greatest mechanical advantage when most needed, that is, when the support arms approach perpendicularly to the shaft (1) and the cover is being brought to maximum tangential and radial tension.

Because of the stability of the conical tension membrane structure, according to the invention, and the ease with which they may be brought to the fully extended position, they may be made to a large size, affording shade and weather protection to a considerable area while maintaining stability in high winds. Although the embodiment shown in the drawings is substantially of regular octagonal shape in plan view, structures according the invention may be made to a wide variety of shapes. The support arms may be of differing lengths, and the angles between succeeding arms, when extended, may vary. Means may be provided for suspending curtain walls from the periphery of the cover to form an enclosed, or partly enclosed shelter.

The radial cables can also have the cable terminations (26) well under the top plate (3), which gives the added opportunity for very steep cores.

It may be preferred, in certain applications of the invention, that the shaft (1) should be telescopic, comprising a lower tubular part having an upper part fixed to the sleeve, or perhaps the sleeve may no longer be required, and an upper tubular part is slidable in the lower tubular part with the ring (4) fixed to the top of the upper tubular part. Any suitable mechanism is provided for extending the upper part of the shaft telescopically to open the umbrella, and for retracting it to close the structure. For example, a rack and pinion device may be incorporated in the structure and manually operated through a crank handle or a cable and pulley system, or a hydraulic system, or the upper part of a telescopic shaft may be threaded and engaged by a nut bearing rotatable on the top of the sleeve and lower shaft.

The foregoing and many other modifications of constructional detail and design, which will be readily apparent to skilled persons, are considered to lie with in the scope of the invention and defined by the appended claims.

We claim:

1. A conical tension membrane structure including:

a shaft, a sleeve which is slidable on said shaft, a pliable cover, cover attachment means for securing the cover substantially centrally to an upper part of the shaft, at least three support arms, arm attachment means for connecting the support arms pivotally at one end to said sleeve, the support arms being connected to the sleeve at a point of connection, the point of connection being below the cover attachment means, the other ends of the support arms being secured at spaced positions to a peripheral part of the cover, radial cables under the fabric cover, attached to the cover attachment means and bolted to the other ends of the arms, and hold-down cables attached to the sleeve and to the other ends of the support arms, the hold-down cables being attached to the sleeve below said point of connection, the structure further comprising actuating means for bringing the arm attachment means and the cover attachment means towards each other to fold the support arms, hold-down cables, radial cables and cover, and away from each other to extend the support arms substantially perpendicular to the shaft, opening the cover and tensioning the cover radially and tangentially, and also tensioning the hold-down cables and radial cables.

2. The conical tension membrane structure of claim 1, wherein the arms are paired with one of said arms of said pairs tangential to the shaft and sleeve in a clockwise tangential manner, while the other of said arms of said pairs are tangential to the shaft and sleeve in a counterclockwise manner.

3. The conical tension membrane structure of claim 1, wherein the cover is supported by the radial cables extending from the cover attachment means to the positions at which the support arms are secured to the peripheral part of the cover.

4. The conical tension membrane structure of claim 3, wherein the cover attachment means includes a top plate and a ring secured coaxially to the upper part of the shaft, cable termination fixing points located on the plate, and a cap mounted on the upper part of the shaft.

5. The conical tension membrane structure of claim 3, wherein the cover attachment means includes a plate secured coaxially to the upper part of the shaft and a cap is mounted on the upper part of the shaft.

6. The conical tension membrane structure of claim 1, wherein the support arms are pivoted to the sleeve about axes substantially tangential to a circle centered on the axis of the sleeve.

7. The conical tension membrane structure of claim 6, wherein the actuating means include means for moving the sleeve slidable towards or from the cover attachment means.

8. The conical tension membrane structure of claim 7, wherein the means for moving the sleeve slidably include a lever fulcrumed on the shaft and a link from the lever to the sleeve.

9. A conical tension membrane structure including:

a shaft, a pliable cover, means for securing the cover to the shaft, at least three support arms, a sleeve which is slidable along the shaft, means for connecting inner ends of the support arms pivotally to the sleeve, the support arms being connected to the sleeve at a point of connection, the point of connection being below the securing means, means for connecting outer ends of the support arms to a peripheral part of the cover, radial cables attached to the securing means and connected to the outer ends end of the arms, and hold-down cables attached to the sleeve and to the outer ends of the support arms, the hold-down cables being attached to the sleeve below said point of connection.

* * * * *